US007866123B2

(12) United States Patent
Clüsserath

(10) Patent No.: US 7,866,123 B2
(45) Date of Patent: Jan. 11, 2011

(54) MULTILEVEL CONTAINER FILLING MACHINE SUCH AS A MULTILEVEL BEVERAGE BOTTLE FILLING MACHINE

(75) Inventor: Ludwig Clüsserath, Bad Kreuznach (DE)

(73) Assignee: KHS AG, Dortmund (DE)

( * ) Notice: Subject to any disclaimer, the term of this patent is extended or adjusted under 35 U.S.C. 154(b) by 189 days.

(21) Appl. No.: 12/348,043

(22) Filed: Jan. 2, 2009

(65) Prior Publication Data

US 2010/0000182 A1 Jan. 7, 2010

Related U.S. Application Data

(63) Continuation-in-part of application No. PCT/EP2007/006288, filed on Jul. 16, 2007.

(30) Foreign Application Priority Data

Jul. 18, 2006 (DE) ..... 10 2006 033 111

(51) Int. Cl.
*B67C 7/00* (2006.01)
*B67C 3/24* (2006.01)

(52) U.S. Cl. ..... 53/202; 53/266.1; 53/279; 53/281; 141/144; 141/169; 141/234

(58) Field of Classification Search ..... 53/202, 53/266.1, 279, 281, 282, 284.5; 141/144, 141/169, 234, 237; *B67C 3/24, 7/00*
See application file for complete search history.

(56) References Cited

U.S. PATENT DOCUMENTS 2,775,269 A * 12/1956 Breeback ..... 141/237
4,053,003 A * 10/1977 Ferrero et al. ..... 141/144
4,467,847 A * 8/1984 Zodrow ..... 53/202
5,069,883 A * 12/1991 Matonte ..... 141/234
5,337,796 A * 8/1994 Ohmori et al. ..... 141/144
5,581,975 A * 12/1996 Trebbi et al. ..... 53/282
2005/0045244 A1* 3/2005 Hartness et al. ..... 141/144
2005/0284537 A1* 12/2005 Hartness et al. ..... 141/144

FOREIGN PATENT DOCUMENTS

DE 32 31 128 2/1984
DE 37 03 151 8/1988
DE 199 28 325 12/2000
DE 203 04 296 7/2004

OTHER PUBLICATIONS

Machine translation of DE 3703151 from EPO website, retrieved Aug. 26, 2010, 5 pages.*
International Search Report PCT/EP2007/006288 and English translation thereof, mailed Nov. 5, 2007, 4 pages.
International Preliminary Report on Patentability PCT/EP2007/006288 and English translation thereof, mailed Feb. 19, 2009, 9 pages.

* cited by examiner

*Primary Examiner*—Stephen F Gerrity
(74) *Attorney, Agent, or Firm*—Nils H. Ljungman & Associates

(57) ABSTRACT

A filling machine for containers such as bottles, cans, or similar containers. The filling machine comprises at least one rotor, which is driven in rotation around a vertical machine axis, and filling stations on the rotor. Each filling station is designed to receive a container and for the filling of this container during the rotational movement of the rotor between a container inlet point and a container outlet point. The filling stations are provided in at least two filling planes, which are offset from one another in the direction of the machine axis.

20 Claims, 4 Drawing Sheets

MULTILEVEL CONTAINER FILLING MACHINE SUCH AS A MULTILEVEL BEVERAGE BOTTLE FILLING MACHINE

CONTINUING APPLICATION DATA

This application is a Continuation-In-Part application of International Patent Application No. PCT/EP2007/006288, filed on Jul. 16, 2007, which claims priority from Federal Republic of Germany Patent Application No. 10 2006 033 111.7, filed on Jul. 18, 2006. International Patent Application No. PCT/EP2007/006288 was pending as of the filing date of this application. The United States was an elected state in International Patent Application No. PCT/EP2007/006288.

BACKGROUND

1. Technical Field

The present application relates to a multilevel container filling machine such as a multilevel beverage bottle filling machine.

2. Background Information

Background information is for informational purposes only and does not necessarily admit that subsequently mentioned information and publications are prior art.

"Containers" within the meaning of the present application include but are not limited to bottles, cans, tubes and other containers which are used and/or are suitable for use as packing means for a wide variety of bulk goods to be packaged, and for example for liquid and/or viscous liquids.

When packing means or containers of this type are filled, filling machines are used that employ a rotary construction and process a high number of containers per unit of time, and possibly machines that have a rotor which is driven in rotation continuously and/or in a clocked manner around a vertical machine axis, on which rotor the filling of the containers is performed in filling stations during the rotational movement of the rotor between a container inlet and a container outlet. The filling stations are thereby located at uniform angular intervals around the vertical machine axis. Because the filling of the containers occurs during the rotational motion of the rotor between the container inlet and the container outlet, basically there is an angular range of less than three hundred sixty degrees of the rotational movement of the rotor available for the filling, i.e. even under optimized conditions, this angular range is on the order of magnitude of three hundred thirty degrees.

When the machine is operating at a high production rate, i.e. at a rate that is required or desired for filling machines that employ a rotary construction, this limited angular range of the rotational motion of the rotor that is available for the filling leads to extremely large rotor diameters which are required or desired to make it possible achieve a sufficient filling distance at a high production rate and thus at a high speed of rotation of the rotor. For example, on filling machines that operate at high production rates, rotor diameters in an order of magnitude of seven and one half meters are altogether common.

OBJECT OR OBJECTS

An object of the present application is to create a filling machine which has a compact design, occupies a small amount of space and is capable of treating containers at a high production rate, and in one possible embodiment one that has an operationally safe and reliable constructive realization. The present application teaches that this object is accomplished by the filling machine for containers such as bottles, cans, or similar containers. The filling machine comprises at least one rotor, which is driven in rotation around a vertical machine axis, and filling stations on the rotor. Each filling station is designed to receive a container and for the filling of this container during the rotational movement of the rotor between a container inlet point and a container outlet point. The filling stations are provided in at least two filling planes, which are offset from one another in the direction of the machine axis.

SUMMARY

A filling machine for the filling of containers such as bottles, cans, or similar containers is provided. The filling machine comprises at least one rotor which is driven in rotation around a vertical machine axis, and with filling stations on the rotor. Each filling station is designed to receive a container and for the filling of this container during the rotational movement of the rotor between a container inlet point and a container outlet point.

One feature of the present application is that the filling stations are provided on the at least one rotor which is driven in rotation around the vertical machine axis not, as in conventional filling machines, in a single filling plane or level, but in at least two filling planes which are offset from one another in the vertical direction, i.e. in the axial direction of the machine axis, i.e. they are located one above another.

For each filling plane, a container inlet and a container outlet are provided, which are then likewise offset from one another in the vertical direction corresponding to the different filling levels, and in one possible embodiment, for example, so that the container inlets and the container outlets are located directly or generally one above the other in the vertical direction and can thus be formed by a common transport and/or transfer element, for example by a common system of transport star wheels, on which container receptacles are provided in the different planes corresponding to the filling planes.

As a result of the filling of the containers in a plurality of filling planes or levels, high production rates can be achieved with a compact realization of the filling machine and in one possible embodiment also with an acceptable rotor diameter, and that in one possible embodiment the individual filling planes and the filling stations located in them and the container inlets and outlets can be realized using a standard and reliable technology.

The containers are fed to the filling machine or to a plant that includes this filling machine in the different filling planes corresponding to the planes that are offset from one other in the vertical direction, and are also removed from the filling machine or a plant that includes this machine in planes that are offset from one another in the vertical direction. The necessary or desired separation or guidance of the stream of containers into the different planes or from the different planes takes place outside the filling machine, as a result of which, among other things, a simplified and very reliable construction of this machine becomes possible.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are disclosed according to at least one possible embodiment of the present application. The present application is explained in greater detail below with reference to one possible embodiment which is illustrated in the accompanying drawings, in which.

DESCRIPTION OF EMBODIMENT OR EMBODIMENTS

In the figures, 1 is a plant for the filling of containers 2 in the form of bottles, which in the illustrated possible embodiment are made of plastic (PET, for example), and are manufactured with a projecting container flange 2.2 on their bottle or container neck below the container mouth 2.1.

Figure 1:
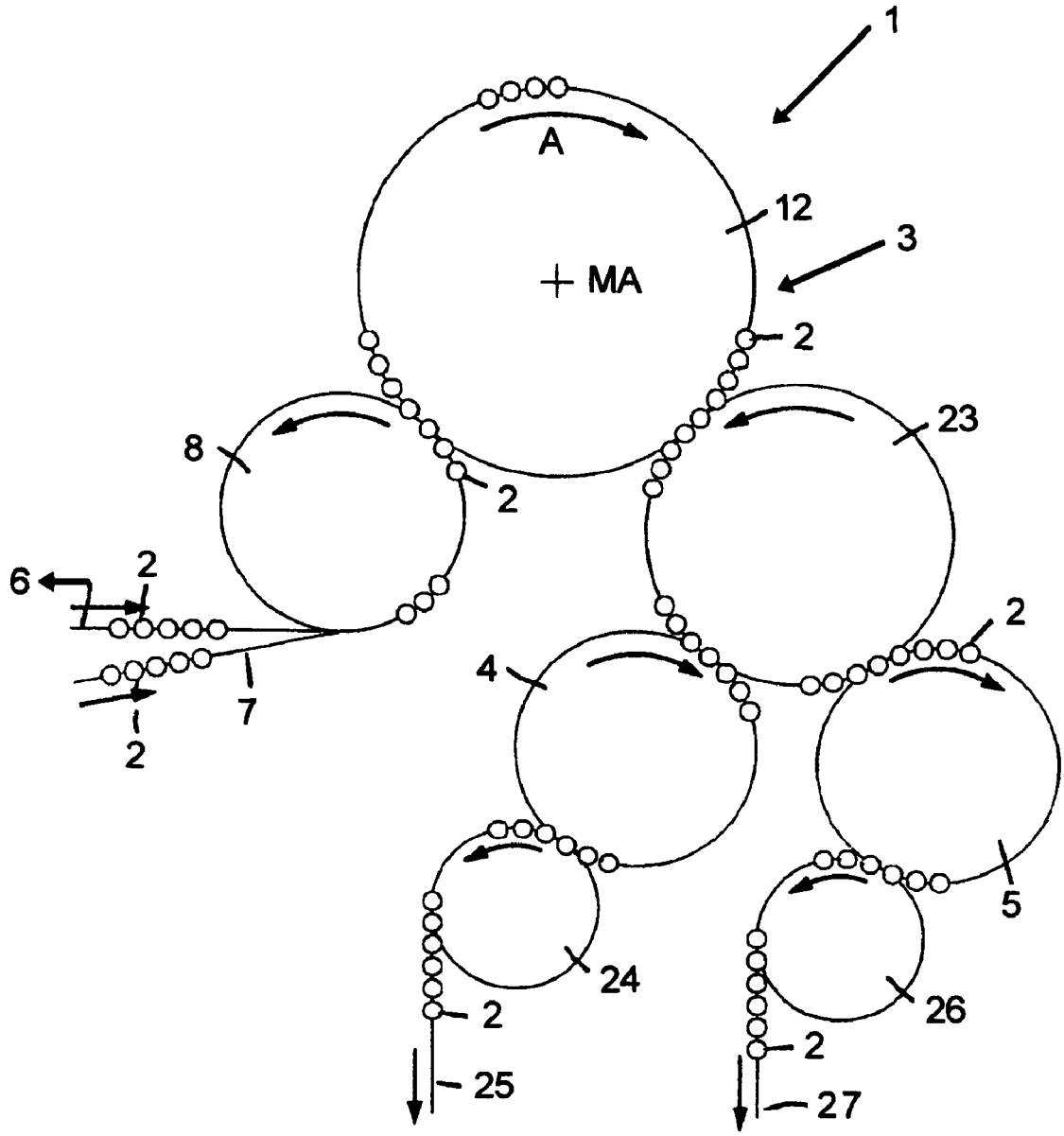
FIG. 1 is a schematic illustration in a plan view of a plant for the filling of containers in the form of bottles, i.e. in the illustrated possible embodiment for the filling and capping of bottles.

In the illustrated possible embodiment, the plant 1 is used for the filling of the containers 2 with a liquid and for the subsequent closing or capping of these containers 2. For this purpose, the plant 1 has, among other things, a filling machine 3 and two closing or capping machines 4 and 5. To achieve high production rates with the most compact possible realization of the plant 1 and the smallest possible space requirement for this plant, and in one possible embodiment also for the filling machine 3, the containers 2 are filled simultaneously or substantially simultaneously in two filling planes E1 and E2 which are located one above the other in the vertical direction. For this purpose, the containers 2 are fed, each in a single-file stream of containers, via two conveyors 6 and 7 in different planes that are offset from one another in the vertical direction and correspond to the filling planes E1 and E2 to a container inlet which is formed by a transport star wheel system 8. For purposes of illustration, the two conveyors 6 and 7 in FIG. 1 are depicted so that when the plant 1 is viewed from overhead, they enclose an angle between them. In a practical realization, however, the conveyors 6 and 7 are located one above the other in the vertical direction, whereby the conveyor 6 is associated with the upper filling plane E1 and the conveyor 7 is associated with the lower filling plane E2.

The system of transport star wheels 8 comprise, among other things, two transport star wheels 9 and 10 which are located one above the other in the vertical direction and are driven in rotation around a common vertical axis, whereby the transport star wheel 9 is associated with the upper filling plane E1 and the transport star wheel 10 is associated with the lower filling plane E2. The common drive of the two transport star wheels 9 and 10 is provided by a variable-speed drive motor 11 which drives these transport star wheels in synchronization with the rotor 12 of the filling machine 3, which rotor 12 is driven in rotation around a vertical machine axis MA.

On the periphery of the rotor 12, in both of the filling planes E1 and E2 which are offset from one another in the vertical direction, there are a plurality of filling positions 13 (in the upper filling plane E1) and 14 (in the lower filling plane E2). In the illustrated possible embodiment, the number of filling positions 13 in the upper filling plane E1 is equal to the number of filling stations 14 in the lower filling plane E2, and in each plane the filling stations 13 and 14 respectively are distributed at uniform angular intervals around the axis MA, and in one possible embodiment, for example, so that a filling station 14 is located below each filling station 13. The filling stations 13 and 14 in the illustrated possible embodiment are realized identically and are used for the filling of identical bottles or containers 2, i.e. each filling station 13 and 14 respectively comprises a filling element 15 for the controlled dispensing of the liquid to be bottled into the individual containers 2 which are located in the filling stations, and of a container carrier 16, on which the individual container 2 is held suspended by its container flange 2.2, so that it is located with its container mouth 2.1 under the filling element 15 or under a dispensing opening realized on this filling element for the liquid being bottled. The filling planes E1 and E2, for example, are those planes in which the container carriers are located during the filling.

The filling elements 15 can be realized in the widest possible number of ways, and in one possible embodiment, for example, for an open jet filling, in which the respective container 2 is located with its container mouth 2.1 at some distance from the filling element 15 or from the dispensing opening formed on the underside of the filling element 15, or for a filling, in one possible embodiment a counterpressure filling process, in which the individual container 2 is in sealed contact with its container mouth against the filling element 15, for example as the result of a controlled elevation of the container carrier 16. Other realizations of the filling process and of the filling elements 15 are also possible, such as the use of filling elements 15 with a filling tube, etc.

The filling elements 15 of the filling stations 13 and 14 are in communication via liquid connections 17 and 18 with a bowl 19 (for example a ring bowl) for the liquid being bottled which is common to the filling stations 13 and 14 and is provided on the rotor 12. The bowl 19 is thereby located on a level above the dispensing openings of the filling elements 15 of the filling stations 13 and thus on a level which is significantly higher than the dispensing opening of the filling elements 15 of the lower filling stations 14. In the liquid connections 17 and 18, there is an individual flow meter 20 for each filling element 15 of the filling stations 13 and 14, and in one possible embodiment, for example, in the form of a magnetic inductive flow meter. The filling process is controlled by means of signals supplied by these flow meters as a function of volume in each filling station 13 and 14.

Associated with the filling stations 13 of the upper filling plane and the filling stations 14 of the lower filling plane are also a plurality of ring ducts 21 and 22 which perform a wide variety of functions, depending on the individual type of filling process, serving, for example, as vacuum ducts, return gas ducts, steam ducts, etc.

Each container 2 which is fed via the conveyor 6 and 7 travels via the transport star wheel 9 and 10 respectively associated with this conveyor and the corresponding filling plane E1 and E2 to a filling station 13 (containers 2 fed via the conveyor 6) or to a filling station 14 (containers 2 fed via the conveyor 7). Over the angular area of the rotational movement A of the rotor 12 between the container inlet formed by the inlet star wheel system 8 and a container outlet of the filling machine 3 formed by a transport star wheel system 23, the containers 2 are filled in a volume-controlled manner and are then removed from the filling stations 13 and 14 respectively at the transport star wheel system 23. The latter comprises in turn two transport start wheels located one above the other in the vertical direction and driven around a common vertical axis, corresponding to the transport star wheels 9 and 10, on which the containers 2 are then in turn provided in two different planes located one above the other in the vertical direction and corresponding to the two different filling planes E1 and E2.

By means of the transport star wheel system 23, the containers 2 reach the upper plane E1 for closing or capping in the closing or capping machine 4 and filling stations that are located there, and then after the closing or capping are fed via a transport star wheel 24 that forms the container outlet of the plant 1 to a conveyor 24 for the outward transport of the filled and closed or capped containers 2. The containers 2 that are filled at the filling stations 14 of the lower filling plane E2 and are transferred to the lower transport star wheel of the transport star wheel system 23, are further transported from there for closing or capping to the closing or capping machine 5 and to filling stations of this machine, and are then delivered via a transport star wheel 26 to a conveyor 27 for outward transport.

To compensate for the geodetic difference in altitude when a common bowl 19 is used for the filling elements 15 of the upper filling stations 13 and the lower filling stations 14, a corresponding element 18.1 is provided in the liquid connection 18. In one possible embodiment, this element 18.1 is provided in common for the filling elements 15 of the filling stations 14. Basically, however, it is also possible to provide an independent element 18.1 for each filling element of the filling stations 14. Solutions are also possible in which one element 18.1 is provided for a group of filling elements 15.

The elements 18.1 can be a choke, for example, which reduces the energy content which differs on account of the geodetic difference in altitude. The elements 18.1 can also be flow control values or flow governor valves. In one possible embodiment, the elements 18.1 can be adjusted manually or by a (centralized) remote control.

Just as in the individual filling stations 13 and 14, the containers 2 in the illustrated possible embodiment are held suspended, each on their container flange 2.2, on the elements that carry these containers and/or interact with them and/or guide them, i.e. in one possible embodiment also on the conveyors 6, 7, 25, 27, on the transport star wheel systems 8 and 23 and on the transport star wheels located there, in the stations of the capping machines 4 and 5 and in the transport star wheels 24 and 26.

Figure 2:
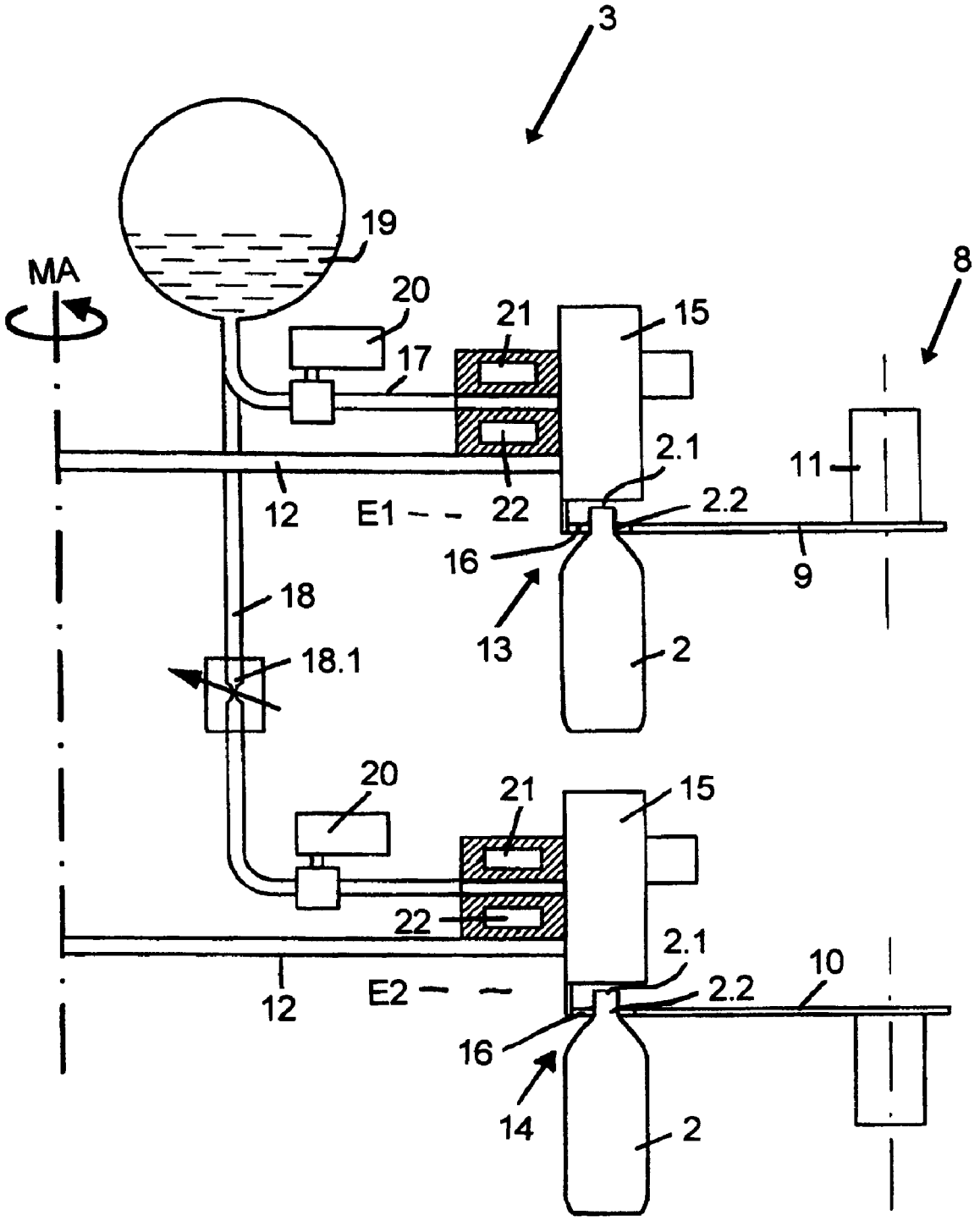
FIG. 2 is a schematic illustration of two filling stations, each of which comprises a container in filling stations located in different stations on a rotor.
Figure 3:
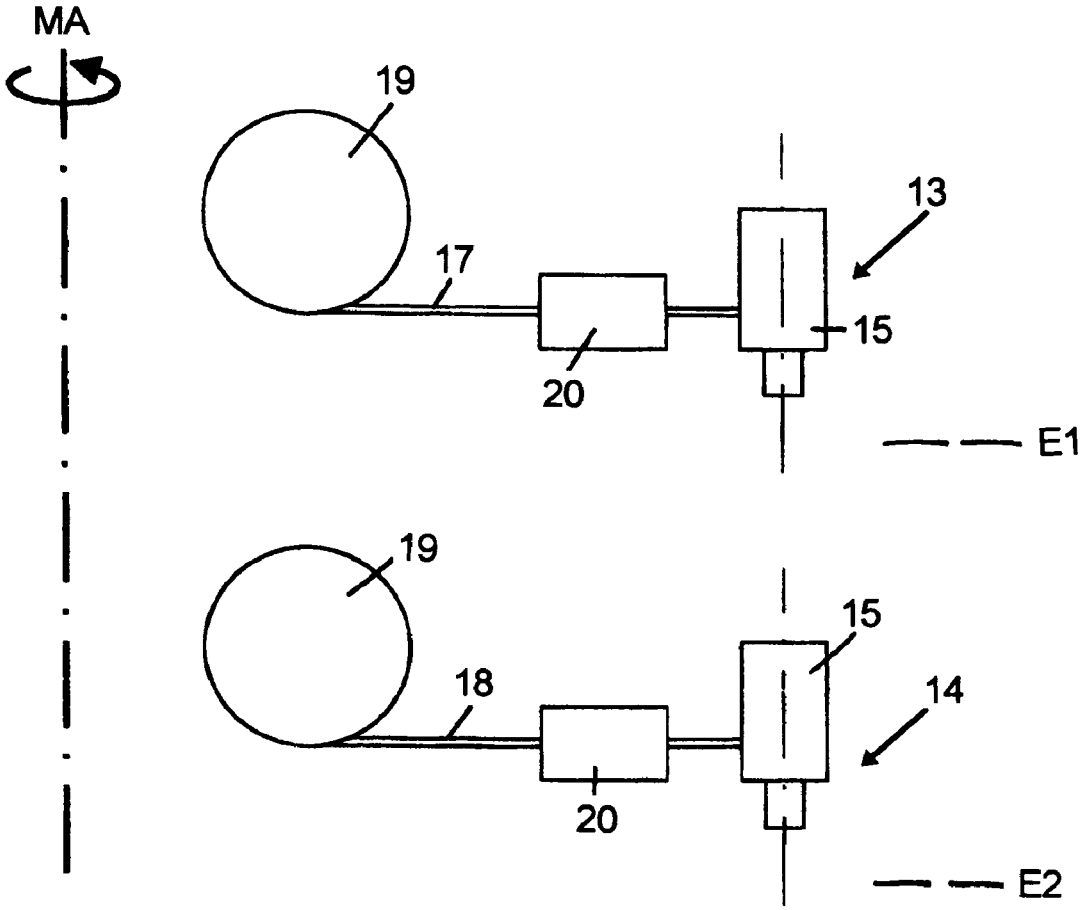
FIG. 3 is a simplified schematic illustration of two filling elements associated with different filling levels, each with an independent bowl for each filling plane.

FIG. 3 shows in a very schematic drawing one realization of the filling machine 3 which differs from the possible embodiment illustrated in FIG. 2 in that an independent bowl 19 is associated with each filling plane E1 and E2, so that the geodetic altitudes are the same for the two filling planes.

Figure 4:
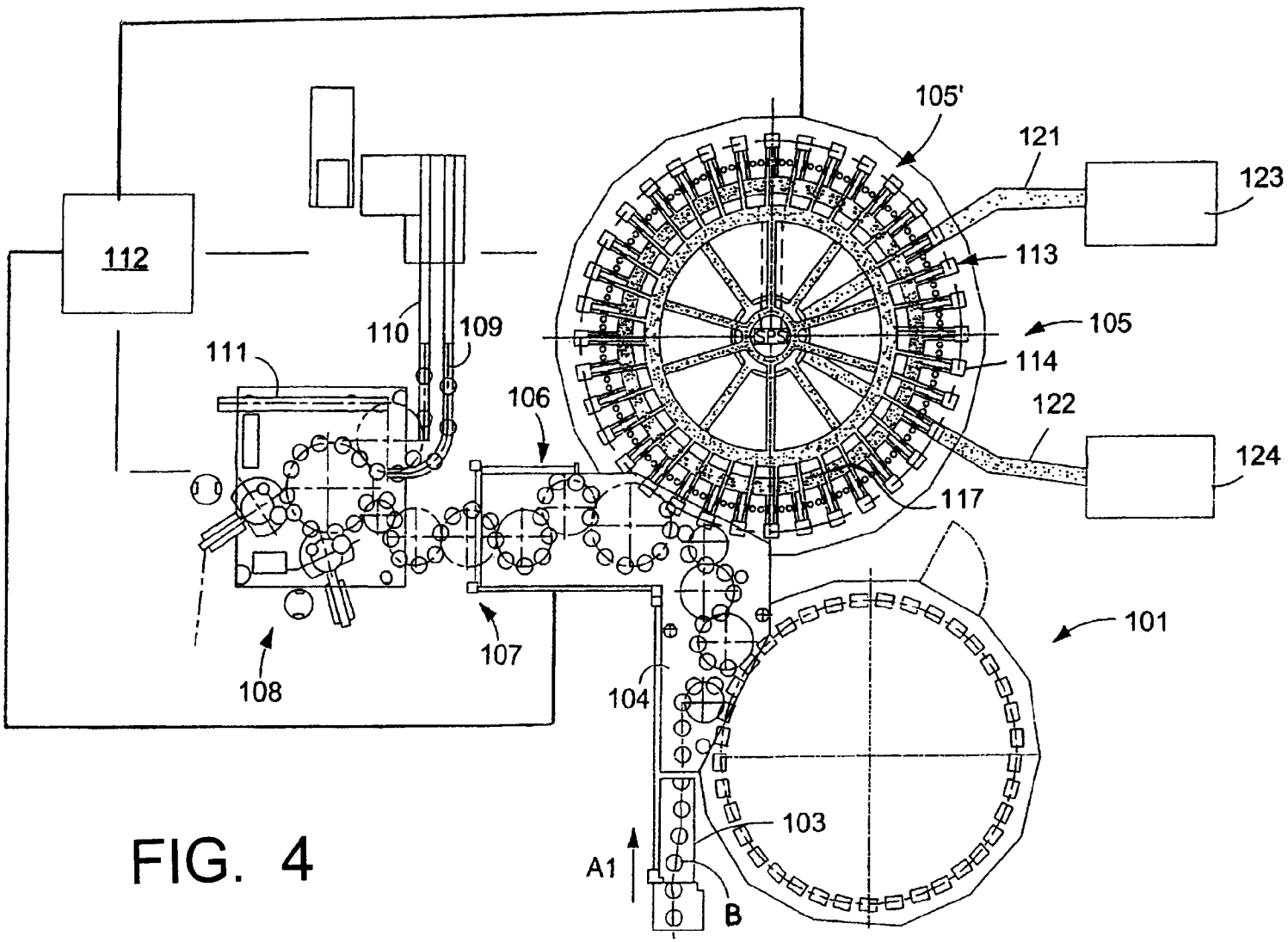
FIG. 4 is a simplified illustration of a bottling plant.

FIG. 4 shows schematically the main components of one possible example of a system for filling containers, specifically, a beverage bottling plant 100 for filling bottles B with at least one liquid beverage. Such a bottling plant may be disclosed in U.S. Pat. No. 7,415,816, incorporated herein by reference in its entirety. In accordance with at least one possible embodiment, in which system or plant could possibly be utilized at least one aspect, or several aspects, of the embodiments is disclosed herein.

FIG. 4 shows an example of a bottling plant in which aspects of the present disclosure may be utilized. Rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 113 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 4, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application was described above on the basis of one possible embodiment. It goes without saying that modifications and variations can be introduced without thereby going beyond the teaching of the present application. For example, it is possible to provide the filling stations in more than two filling levels that are located one above the other in the vertical direction. Basically it is also possible to fill containers 2 of different types and/or sizes in the filling planes.

This present application relates to a filling machine for containers such as bottles, cans or similar containers, for example a filling machine for the filling of a liquid into the containers, with at least one rotor which is driven in rotation around a vertical machine axis, and with filling stations on the rotor, each of which holds one container, and for the filling of this container during the rotational movement of the rotor between a container delivery point and a container discharge point.

One feature or aspect of an embodiment is believed at the time if the filing of this patent application to possibly reside broadly in a filling machine for containers 2 such as bottles, cans or similar containers, with at least one rotor 12 which is driven in rotation around a vertical machine axis MA and with filling stations 13, 14 on the rotor 12 each of which is designed receive a container and for the filling of this container during the rotational movement of the rotor 12 between a container inlet point 8 and a container outlet point 24, wherein the filling stations 13, 14 are provided in at least two filling planes E1, E2 which are offset from one another in the direction of the machine axis MA.

Another feature or aspect of an embodiment is believed at the time if the filing of this patent application to possibly reside broadly in the filling machine, wherein associated with each filling plane E1, E2 is a container inlet 9, 10 and/or a container outlet, and that the container inlets 9, 10 and container outlets are located offset from one another or are located one above the other in the axial direction of the machine axis MA corresponding to the filling levels E1, E2.

Yet another feature or aspect of an embodiment is believed at the time if the filing of this patent application to possibly reside broadly in the filling machine, wherein the number of filling stations 13, 14 in the filling planes E1, E2 is different.

Still another feature or aspect of an embodiment is believed at the time if the filing of this patent application to possibly reside broadly in the filling machine, wherein the number of filling stations 13, 14 in the filling planes E1, E2 is the same.

A further feature or aspect of an embodiment is believed at the time if the filing of this patent application to possibly reside broadly in the filling machine, wherein the filling stations 13, 14 of neighboring filling planes are each offset from one another in the peripheral direction of the rotor 12.

Yet another feature or aspect of an embodiment is believed at the time if the filing of this patent application to possibly reside broadly in the filling machine, wherein the filling stations 13, 14 of neighboring filling planes are directly above one another in the direction of the machine axis MA.

Still another feature or aspect of an embodiment is believed at the time if the filing of this patent application to possibly reside broadly in the filling machine, wherein the container inlets 9, 10 and/or container outlets associated with the individual filling planes E1, E2 are offset from one another in the peripheral direction of the rotor 12.

A further feature or aspect of an embodiment is believed at the time if the filing of this patent application to possibly reside broadly in the filling machine, wherein the container inlets and/or container outlets associated with the filling planes E1, E2 are directly above one another in the vertical direction and in the direction of the machine axis MA.

Another feature or aspect of an embodiment is believed at the time if the filing of this patent application to possibly reside broadly in the filling machine, wherein the container inlets and/or the container outlets are formed by a transport star wheel system 8, 24, which each have receptacles for the containers 2 in the different planes corresponding to the filling planes E1, E2.

Yet another feature or aspect of an embodiment is believed at the time if the filing of this patent application to possibly reside broadly in the filling machine, wherein the container inlets and/or container outlets are each formed by a transport star wheel 9, 10.

Still another feature or aspect of an embodiment is believed at the time if the filing of this patent application to possibly reside broadly in the filling machine, wherein the filling stations each have a filling head 15 as well as a container carrier 16 for the accurately positioned holding of the individual container 2 in relation to the filling head 15.

A further feature or aspect of an embodiment is believed at the time if the filing of this patent application to possibly reside broadly in the filling machine, wherein for the filling heads 15 of each filling plane E1, E2 or for each group of such filling heads 15 there is at least one common duct 21, 22 for the delivery or removal of a gas and/or vapor and/or liquid medium.

Another feature or aspect of an embodiment is believed at the time if the filing of this patent application to possibly reside broadly in the filling machine, wherein the filling stations 13, 14 are realized for the cleaning and/or sterilization of the containers 2.

Yet another feature or aspect of an embodiment is believed at the time if the filing of this patent application to possibly reside broadly in the filling machine, wherein the filling stations 13, 14 are realized in the form of filling stations for the filling of the containers 2 with a bulk or liquid product, and that the filling heads are filling elements 15 for the controlled dispensing of the bulk or liquid product into the containers 2.

Still another feature or aspect of an embodiment is believed at the time if the filing of this patent application to possibly reside broadly in the filling machine, wherein at least one chamber or at least one independent bowl 19 is associated with the filling stations 13, 14 and/or the filling element 15 of each filling plane E1, E2, which chamber or bowl is used to hold the bulk product or liquid being bottled, and is in communication via liquid connections 17, 18 with the filling elements of the corresponding filling plane E1, E2.

A further feature or aspect of an embodiment is believed at the time if the filing of this patent application to possibly reside broadly in the filling machine, wherein for the filling stations 13, 14 and for the filling elements 15 of at least two different filling planes E1, E2 there is at least one common bowl 19 to hold the liquid being bottled, and that the filling elements of these filling planes E1, E2 are in communication with the bowl 19 via liquid connections 17, 18.

Another feature or aspect of an embodiment is believed at the time if the filing of this patent application to possibly reside broadly in the filling machine, wherein in the liquid connection 18 which connects the filling elements 15 of the lower of the at least two filling planes E1, E2 with the common bowl 19, there is at least one pressure-reducing element, e.g. a choke 18.1, for example an adjustable choke.

Yet another feature or aspect of an embodiment is believed at the time if the filing of this patent application to possibly reside broadly in the filling machine, wherein on the container outlet of at least one filling plane E1, E2 there is an additional unit 4, 5 for the treatment of the containers 2, for example for the capping or closing of the containers 2.

Still another feature or aspect of an embodiment is believed at the time if the filing of this patent application to possibly reside broadly in the filling machine, wherein the containers 2 are fed to the filling machine via conveyors 6, 7 in planes that correspond to the filling planes E1, E2 and are offset from one another in the vertical direction and/or after the filling are transported outward via conveyors 25, 27 in different planes that are offset from one another in the vertical direction corresponding to the filling planes E1, E2.

A further feature or aspect of an embodiment is believed at the time if the filing of this patent application to possibly reside broadly in the filling machine, wherein its realization is for the filling of containers (2) in the form of bottles, in one possible embodiment plastic bottles.

Another feature or aspect of an embodiment is believed at the time if the filing of this patent application to possibly reside broadly in the filling machine, wherein the functional elements of the filling machine that carry and/or guide the containers 2 are at least partly realized so that the containers 2 are held and/or guided on them in a suspended position by means of a container flange 2.2 that is realized in the vicinity of a container mouth 2.1.

Yet another feature or aspect of an embodiment is believed at the time if the filing of this patent application to possibly reside broadly in the filling machine, wherein an individual flow meter 20, for example a magnetic inductive flow meter, is provided in the liquid connections 17, 18 for each filling element 15.

Still another feature or aspect of an embodiment is believed at the time if the filing of this patent application to possibly reside broadly in the filling machine, wherein the filling stations 13, 14 of the different filling planes E1, E2 are realized for the filling of containers 2 of different types and/or sizes.

A further feature or aspect of an embodiment is believed at the time if the filing of this patent application to possibly reside broadly in the filling machine, wherein the filling stations 13, 14 of the different filling planes E1, E2 are realized for different fillings of the containers 2.

One feature or aspect of an embodiment is believed at the time if the filing of this patent application to possibly reside broadly in a plant for the filling of containers 2 such as bottles, cans or similar containers with a liquid and for the subsequent closing or capping of the containers 2 with a filling machine with at least one rotor 12 which is driven in rotation around a vertical machine axis MA and with filling stations 13, 14 on the rotor 12 that have filling elements 15 for the holding and filling of the containers 2 during the rotational movement of the rotor 12 between a container inlet point 8 and a container outlet point 24, whereby the filling stations 13, 14 are provided in at least two filling planes E1, E2 which are offset from one another in the direction of the machine axis MA and with a closing or capping device for the closing or capping of the filled containers 2 in the different filling planes E1, E2, comprising a transport device 23 provided between the container discharge point 24 of the filling machine and the capping or closing device for the transport of the filled containers in the different filling levels E1, E2 to the closing or capping machines 4, 5 that form the closing or capping device, each of which is provided for the closing or capping of the containers 2 of one of the filling planes E1, E2.

Another feature or aspect of an embodiment is believed at the time if the filing of this patent application to possibly reside broadly in the plant, wherein associated with each filling plane E1, E2 is a container inlet 9, 10 and/or a container outlet, and that the container inlets 9, 10 and container outlets are located offset from one another or are located one above the other in the axial direction of the machine axis MA corresponding to the filling levels E1, E2.

Yet another feature or aspect of an embodiment is believed at the time if the filing of this patent application to possibly reside broadly in the plant, wherein the container inlets and/or the container outlets of the filling machine 3 are formed by a transport star wheel system 8, 23 which has receptacles for the containers 2 in different planes corresponding to each of the filling planes E1, E2.

Still another feature or aspect of an embodiment is believed at the time if the filing of this patent application to possibly reside broadly in the plant, wherein the transport star wheel system that forms the container outlet of the filling machine is the transport star wheel system 23 located between the filling machine 3 and the closing or capping machines 4, 5.

A further feature or aspect of an embodiment is believed at the time if the filing of this patent application to possibly reside broadly in the plant, wherein the filling stations 13, 14 have a container carrier 16 for the accurately positioned holding of the individual container 2 in relation to the filling element 15.

Another feature or aspect of an embodiment is believed at the time if the filing of this patent application to possibly reside broadly in the plant, wherein for the filling elements 15 of each filling plane E1, E2 or for each group of such filling elements 15 there is at least one common duct 21, 22 for the delivery or removal of a gas and/or vapor and/or liquid medium.

Yet another feature or aspect of an embodiment is believed at the time if the filing of this patent application to possibly reside broadly in the plant, wherein at least one chamber or at least one independent bowl 19 is associated with the filling elements 15 of each filling plane E1, E2, which chamber or bowl is used to hold the bulk product or liquid being bottled, and is in communication via liquid connections 17, 18 with the filling elements of the corresponding filling plane E1, E2.

Still another feature or aspect of an embodiment is believed at the time if the filing of this patent application to possibly reside broadly in the plant, wherein for the filling elements 15 of at least two different filling planes E1, E2 there is at least one common bowl 19 to hold the liquid being bottled, and that the filling elements of these filling planes E1, E2 are in communication with the bowl 19 via liquid connections 17, 18.

A further feature or aspect of an embodiment is believed at the time if the filing of this patent application to possibly reside broadly in the plant, wherein in the liquid connection 18 which connects the filling elements 15 of the lower of the at least two filling planes E1, E2 with the common bowl 19, there is at least one pressure-reducing element, e.g. a choke 18.1, for example an adjustable choke.

Another feature or aspect of an embodiment is believed at the time if the filing of this patent application to possibly reside broadly in the plant, wherein the containers 2 are fed to the filling machine 3 via conveyors 6, 7 in planes that correspond to the filling planes E1, E2 and are offset from one another in the vertical direction and/or after the filling are transported outward via conveyors 25, 27 in different planes that are offset from one another in the vertical direction corresponding to the filling planes E1, E2.

Yet another feature or aspect of an embodiment is believed at the time if the filing of this patent application to possibly reside broadly in the plant, wherein its realization is for the filling and closing or capping of containers 2 in the form of bottles, in one possible embodiment plastic bottles.

Still another feature or aspect of an embodiment is believed at the time if the filing of this patent application to possibly reside broadly in the plant, wherein the functional elements of the filling machine 3 that carry and/or guide the containers 2 are at least partly realized so that the containers 2 are held and/or guided on them in a suspended position by means of a container flange 2.2 that is realized in the vicinity of a container mouth 2.

A further feature or aspect of an embodiment is believed at the time if the filing of this patent application to possibly reside broadly in the plant, wherein an individual flow meter 20, for example a magnetic inductive flow meter, is provided in the liquid connections 17, 18 for each filling element 15.

Another feature or aspect of an embodiment is believed at the time if the filing of this patent application to possibly reside broadly in the plant, wherein the filling stations 13, 14 of the different filling planes E1, E2 are realized for the filling of containers 2 of different types and/or sizes.

One feature or aspect of an embodiment is believed at the time if the filing of this patent application to possibly reside broadly in a filling machine for the filling of containers 2 such as bottles, cans or similar containers with a liquid, with at least one rotor 12 which can be driven in rotation around a vertical machine axis MA and with filling stations 13, 14 on the rotor 12 for the holding and filling of the containers during the rotation of the rotor 12 between a container delivery point 8 and a container discharge point 24, whereby the filling stations 13, 14 are provided in at least two filling planes E1, E2 on the rotor 12 which are offset from one another in the direction of the machine axis MA, wherein for the filling elements 15 of at least two different filling planes E1, E2 there is at least one common bowl 19 to hold the liquid being bottled, that the filling elements of these filling planes E1, E2 are in communication via liquid connections 17, 18 with the bowl 19, and that at least one pressure-reducing element is provided in a liquid connection 18 which connects the filling elements 15 of the lower of the at least two filling planes E1, E2 with the common bowl.

Another feature or aspect of an embodiment is believed at the time if the filing of this patent application to possibly reside broadly in the filling machine, wherein the element that reduces the pressure is a choke 18.1, such as an adjustable choke, for example.

Yet another feature or aspect of an embodiment is believed at the time if the filing of this patent application to possibly reside broadly in the filling machine, wherein associated with each filling plane E1, E2 is a container inlet 9, 10 and/or a container outlet, and that the container inlets 9, 10 and container outlets are located offset from one another or are located one above the other in the axial direction of the machine axis MA corresponding to the filling levels E1, E2.

Still another feature or aspect of an embodiment is believed at the time if the filing of this patent application to possibly reside broadly in the filling machine, wherein the container inlets and/or the container outlets of the filling machine 3 are formed by a transport star wheel system 8, 23, which each have receptacles for the containers 2 in the different planes corresponding to the filling planes E1, E2.

A further feature or aspect of an embodiment is believed at the time if the filing of this patent application to possibly reside broadly in the filling machine, wherein the transport star wheel system that forms the container outlet of the filling machine is the transport star wheel system 23 which is located between the filling machine 3 and the closing or capping machines 4, 5.

Another feature or aspect of an embodiment is believed at the time if the filing of this patent application to possibly reside broadly in the filling machine, wherein the filling stations 13, 14 have a container carrier 16 for the accurately positioned holding of the individual container 2 in relation to the filling element 15.

Yet another feature or aspect of an embodiment is believed at the time if the filing of this patent application to possibly reside broadly in the filling machine, wherein for the filling elements 15 of each filling plane E1, E2 or for each group of such filling heads 15 there is at least one common duct 21, 22 for the delivery or removal of a gas and/or vapor and/or liquid medium.

Still another feature or aspect of an embodiment is believed at the time if the filing of this patent application to possibly reside broadly in the filling machine, wherein the containers 2 are fed to the filling machine 3 via conveyors 6, 7 in planes that correspond to the filling planes E1, E2 and are offset from one another in the vertical direction and/or after the closing or capping are transported outward via conveyors 25, 27 in different planes that are offset from one another in the vertical direction corresponding to the filling planes E1, E2.

A further feature or aspect of an embodiment is believed at the time if the filing of this patent application to possibly reside broadly in the filling machine, wherein its realization for the filling and closing or capping of containers 2 in the form of bottles, in one possible embodiment plastic bottles.

Another feature or aspect of an embodiment is believed at the time if the filing of this patent application to possibly reside broadly in the filling machine, wherein the functional elements of the filling machine that carry and/or guide the containers 2 are at least partly realized so that the containers 2 are held and/or guided on them in a suspended position by means of a container flange 2.2 that is realized in the vicinity of a container mouth 2.1.

Yet another feature or aspect of an embodiment is believed at the time if the filing of this patent application to possibly reside broadly in the filling machine, wherein an individual flow meter 20, for example a magnetic inductive flow meter, is provided in the liquid connections 17, 18 for each filling element 15.

Still another feature or aspect of an embodiment is believed at the time if the filing of this patent application to possibly reside broadly in the filling machine, wherein the filling stations 13, 14 of the different filling planes E1, E2 are realized for the filling of containers 2 of different types and/or sizes.

One feature or aspect of an embodiment is believed at the time of the filing of this patent application to possibly reside broadly in a bottling plant for filling bottles with a flowable filling material and capping filled bottles, the bottling plant comprises a bottle filling machine comprising: at least one rotor having a vertical machine axis; the at least one rotor comprising at least an upper and a lower bottle filling wheel rotatable about the vertical machine axis; a plurality of bottle filling elements substantially equally spaced and disposed about a perimeter of the upper and the lower bottle filling wheels; the bottle filling elements disposed with the upper bottle filling wheel being substantially vertically oriented with one of the bottle filling elements disposed with the lower bottle filling wheel; the upper and the lower bottle filling wheels being vertically spaced in substantially parallel planes, the upper and lower bottle filling wheels being vertically spaced by an amount sufficient to permit a bottle filling element and a bottle to be disposed between the upper and the lower bottle filling wheels; the bottle filling elements being configured to dispense a flowable filling material through a lower flowable filling material outlet; the bottle filling elements comprising a flowable filling material inlet above the flowable filling material outlet; the flowable filling material inlets being in flow communication with a corresponding flow meter; the flow meters being in flow communication with a flowable filling material connection; a sole flowable filling material reservoir above the flow meters and in flow communication with the flow meters through the flowable filling material connection; a pressure reducing element in flow communication with the flowable filling material connection, the pressure reducing element being disposed between the upper and the lower bottle filling wheels; the pressure reducing element being configured to reduce pressure of flowable filling material flowing to the lower bottle filling wheel such that the pressure of flowable filling material flowing to the flow meters of the lower bottle filling wheel is substantially equalized with the pressure of flowable filling material flowing to the flow meters of the upper bottle filling wheel; a motor configured to rotate the upper and the lower bottle filling wheels at substantially the same rotational speed about the vertical machine axis; and a bottle carrier below the bottle filling elements configured to receive and dispose a bottle about a bottle flange with a bottle mouth below the flowable filling material outlet of the bottle filling elements; the bottling plant further comprising: a bottle filling machine bottle outlet comprising: an upper conveying apparatus rotatable about a vertical axis thereof configured to collect filled bottles from the upper bottle filling wheel; a lower conveying apparatus rotatable about the vertical axis of the upper conveying apparatus and configured to collect filled bottles from the lower bottle filling wheel; the upper conveying apparatus being configured to dispose bottles through an upper rotational distance; and the lower conveying apparatus being configured to dispose bottles through a lower rotational distance, the upper rotational distance being different than the lower rotational distance; the bottling plant further comprising: an upper bottle capping machine configured to collect filled bottles from the upper conveying apparatus at the upper rotational distance from the bottle filling machine and cap filled bottles; a lower bottle capping machine configured to collect filled bottles from the lower conveying apparatus at the lower rotational distance from the bottle filling machine and cap filled bottles; the difference between the upper and the lower rotational distances of the upper and the lower conveying apparatus being sufficient to dispose the upper and the lower bottle capping machines sufficiently far apart to permit unimpeded operation of the upper and the lower bottle capping machines; and the upper and the lower bottle capping machines each having a height substantially greater than the vertical spacing between the upper and the lower conveying apparatuses.

Another feature or aspect of an embodiment is believed at the time of the filing of this patent application to possibly reside broadly in a bottling plant comprising a bottle conveying apparatus, the bottle conveying apparatus comprising an upper and a lower bottle conveyor, the upper conveyor being configured to convey bottles to the upper bottle filling wheel and the lower conveyor being configured to convey bottles to the lower bottle filling wheel.

Yet another feature or aspect of an embodiment is believed at the time of the filing of this patent application to possibly reside broadly in a bottling plant wherein the upper filling wheel is configured to dispose a bottle of a first size and the lower filling wheel is configured to dispose a bottle of a second size, the first and the second size bottles being different.

Still another feature or aspect of an embodiment is believed at the time of the filing of this patent application to possibly reside broadly in a container filling plant for filling containers with a flowable filling material and closing filled containers, the container filling plant comprising: a container filling machine comprising: at least one rotor having a vertical machine axis; the at least one rotor comprising at least an upper and a lower container filling wheel rotatable about the vertical machine axis; a plurality of container filling elements substantially equally spaced and disposed about a perimeter of the upper and the lower container filling wheels; the upper and the lower container filling wheels being vertically spaced in substantially parallel planes, the upper and lower container filling wheels being vertically spaced by an amount sufficient to permit a container filling element and a container to be disposed between the upper and the lower container filling wheels; the container filling elements being configured to dispense a flowable filling material through a flowable filling material outlet; the container filling elements comprising a flowable filling material inlet; the flowable filling material inlets being in flow communication with a flowable filling material connection; at least one flowable filling material reservoir in flow communication with the flowable filling material inlets of the upper and the lower container filling wheels; a motor configured to rotate the upper and the lower container filling wheels at substantially the same rotational speed about the vertical machine axis; and a container carrier below the container filling elements configured to receive and dispose a container with a container opening below the flowable filling material outlet of the container filling elements; the container filling plant further comprising: a container filling machine container outlet comprising: an upper conveying apparatus rotatable about a vertical axis thereof configured to collect filled containers from the upper container filling wheel; a lower conveying apparatus rotatable about the vertical axis of the upper conveying apparatus and configured to collect filled containers from the lower container filling wheel; the upper conveying apparatus being configured to dispose containers through an upper rotational distance; and the lower conveying apparatus being configured to dispose containers through a lower rotational distance, the upper rotational distance being different than the lower rotational distance; the container filling plant further comprising: an upper container closing machine configured to collect filled containers from the upper conveying apparatus at the upper rotational distance from the container filling machine and close filled containers; a lower container closing machine configured to collect filled containers from the lower conveying apparatus at the lower rotational distance from the container filling machine and close filled containers; the difference between the upper and the lower rotational distances of the upper and the lower conveying apparatuses being sufficient to dispose the upper and the lower container closing machines sufficiently far apart to permit unimpeded operation of the upper and the lower container closing machines; and the upper and the lower container closing machines each having a height substantially greater than the vertical spacing between the upper and the lower conveying apparatuses.

A further feature or aspect of an embodiment is believed at the time of the filing of this patent application to possibly reside broadly in a container filling plant wherein the at least one flowable filling material reservoir is a sole flowable filling material reservoir.

Another feature or aspect of an embodiment is believed at the time of the filing of this patent application to possibly reside broadly in a container filling plant comprising a pressure reducing element in flow communication with the flowable filling material connection between the upper and the lower container filling wheels, the pressure reducing element being configured to reduce pressure of flowable filling material flowing to the lower container filling wheel such that the pressure of flowable filling material flowing to the flowable filling material inlets of the upper and the lower container filling wheels is substantially equal.

Yet another feature or aspect of an embodiment is believed at the time of the filing of this patent application to possibly reside broadly in a container filling plant wherein the pressure reducing element is adjustable.

Still another feature or aspect of an embodiment is believed at the time of the filing of this patent application to possibly reside broadly in a container filling plant comprising a flow meter in flow communication with a corresponding flowable filling material inlet.

A further feature or aspect of an embodiment is believed at the time of the filing of this patent application to possibly reside broadly in a container filling plant comprising at least one duct configured for the delivery or removal of a gas, vapor, liquid, or combinations thereof.

Another feature or aspect of an embodiment is believed at the time of the filing of this patent application to possibly reside broadly in a container filling plant comprising a container conveying apparatus, the container conveying apparatus comprising an upper and a lower container conveyor, the upper conveyor being configured to convey containers to the upper container filling wheel and the lower conveyor being configured to convey containers to the lower container filling wheel.

Yet another feature or aspect of an embodiment is believed at the time of the filing of this patent application to possibly reside broadly in a container filling plant wherein the upper filling wheel is configured to dispose a container of a first size and the lower filling wheel is configured to dispose a container of a second size, the first and the second size containers being different.

Still another feature or aspect of an embodiment is believed at the time of the filing of this patent application to possibly reside broadly in a container filling plant wherein the upper and the lower conveying apparatuses of the container filling machine container outlet are transport star wheels.

A further feature or aspect of an embodiment is believed at the time of the filing of this patent application to possibly reside broadly in a container filling plant for filling containers with a flowable filling material and closing filled containers, the container filling plant comprising: a container filling machine comprising: at least one rotor having a vertical machine axis; the at least one rotor comprising at least an upper and a lower container filling wheel rotatable about the vertical machine axis; a plurality of container filling elements substantially equally spaced and disposed about a perimeter of the upper and the lower container filling wheels; the upper and the lower container filling wheels being vertically spaced in substantially parallel planes, the upper and lower container filling wheels being vertically spaced by an amount sufficient to permit a container filling element and a container to be disposed between the upper and the lower container filling wheels; the container filling elements being configured to dispense a flowable filling material through a lower flowable filling material outlet; the container filling elements comprising a flowable filling material inlet; the flowable filling material inlets being in flow communication with a flowable filling material connection; a sole flowable filling material reservoir in flow communication with the flowable filling material connection; a pressure reducing element being configured to reduce pressure of flowable filling material flowing to the flowable filling material inlets of the lower bottle filling wheel such that the pressure of flowable filling material flowing to the flowable filling material inlets of the lower bottle filling wheel are substantially equalized with the pressure of flowable filling material flowing to the flowable filling material inlets of the upper bottle filling wheel; a motor configured to rotate the upper and the lower container filling wheels at substantially the same rotational speed about the vertical machine axis; and a container carrier below the container filling elements configured to receive and dispose a container with a container opening below the flowable filling material outlet of the container filling elements; the container filling plant further comprising: at least one container closing machine configured to collect and close filled containers from the container filling machine.

Another feature or aspect of an embodiment is believed at the time of the filing of this patent application to possibly reside broadly in a container filling plant comprising a container filling machine container outlet, the container outlet comprising: an upper conveying apparatus rotatable about a vertical axis thereof configured to collect filled containers from the upper container filling wheel; a lower conveying apparatus rotatable about the vertical axis of the upper conveying apparatus and configured to collect filled containers from the lower container filling wheel; the upper conveying apparatus being configured to dispose containers through an upper rotational distance; and the lower conveying apparatus being configured to dispose containers through a lower rotational distance, the upper rotational distance being different than the lower rotational distance.

Yet another feature or aspect of an embodiment is believed at the time of the filing of this patent application to possibly reside broadly in a container filling plant wherein the at least one closing machine comprises: an upper container closing machine configured to collect filled containers from the upper conveying apparatus at the upper rotational distance from the container filling machine and close filled containers; a lower container closing machine configured to collect filled containers from the lower conveying apparatus at the lower rotational distance from the container filling machine and close filled containers; the difference between the upper and the lower rotational distances of the upper and the lower conveying apparatuses being sufficient to dispose the upper and the lower container closing machines sufficiently far apart to permit unimpeded operation of the upper and the lower container closing machines; and the upper and the lower container closing machines each having a height substantially greater than the vertical spacing between the upper and the lower conveying apparatuses.

Still another feature or aspect of an embodiment is believed at the time of the filing of this patent application to possibly reside broadly in a container filling plant wherein the pressure reducing element is adjustable.

A further feature or aspect of an embodiment is believed at the time of the filing of this patent application to possibly reside broadly in a container filling plant comprising a flow meter in flow communication with a corresponding flowable filling material inlet.

Another feature or aspect of an embodiment is believed at the time of the filing of this patent application to possibly reside broadly in a container filling plant comprising at least one duct configured for the delivery or removal of a gas, vapor, liquid, or combinations thereof.

Yet another feature or aspect of an embodiment is believed at the time of the filing of this patent application to possibly reside broadly in a container filling plant comprising a container conveying apparatus, the container conveying apparatus comprising an upper and a lower container conveyor, the upper conveyor being configured to convey containers to the upper container filling wheel and the lower conveyor being configured to convey containers to the lower container filling wheel.

Still another feature or aspect of an embodiment is believed at the time of the filing of this patent application to possibly reside broadly in a container filling plant wherein the upper filling wheel is configured to dispose a container of a first size and the lower filling wheel is configured to dispose a container of a second size, the first and the second size containers being different.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of bottling plants and other features which may possibly be utilizable by at least one possible embodiment may possibly be found in the following: U.S. Pat. No. 7,415,816, having inventor Herbert Bernhard; and U.S. Pat. No. 7,404,277, having inventor Schach et al.

Some examples of container filling machines and other features which may possibly be utilizable by at least one possible embodiment may possibly be found in the following: U.S. Pat. No. 7,469,726, having inventor Clusserath, et al.; U.S. Pat. No. 7,353,848, having inventor Krulitsch; and U.S. Pat. No. 7,347,231, having inventor Schmoll.

Some examples of container closing machines and other features which may possibly be utilizable by at least one possible embodiment may possibly be found in the following: U.S. Pat. No. 7,165,582, having inventor Till; U.S. Pat. No. 7,162,849, having inventor Bernhard; and U.S. Pat. No. 6,484,477, having inventor Bernhard.

Some examples of inductive flow meters and other features which may possibly be utilizable by at least one possible embodiment may possibly be found in the following: U.S. Pat. No. 7,353,848, having inventor Krulitsch; U.S. Pat. No. 7,299,607, having inventor Clusserath; and U.S. patent application Ser. No. 12/343,912, filed on Dec. 24, 2008, having inventor Lorenz.

All of the patents, patent applications or patent publications, which were cited in the International Search Report, and/or cited elsewhere are hereby incorporated by reference as if set forth in their entirety herein as follows: DE 37 03 151, having the following English translation of the German title "ROTATING TREATMENT AND DEVICE FOR DRINKS CONTAINERS," published on Aug. 11, 1988; DE 32 31 128, having the following English translation of the German title "METHOD AND DEVICE FOR LABELLING UPRIGHT RECEPTACLES, ESPECIALLY STACKABLE TIN CANS," published on Feb. 23, 1984; and DE 199 28 325, having the following English translation of the German title "BOTTLE FILLING PLANT FOR POLY(ETHYLENE TEREPHTHALATE) BOTTLES COMPRISES BLOW MOULDING DEVICE, AUTO WASHING MACHINE AND THE FILLING MACHINE, BOTTLES BEING TRANSFERRED TO WASHING MACHINE AFTER MOULDING BY SERIES OF CONVEYORS," published on Dec. 28, 2000.

All of the patents, patent applications or patent publications, which were cited in the German Office Action, and/or cited elsewhere are hereby incorporated by reference as if set forth in their entirety herein as follows: DE 37 03 151, having the following English translation of the German title "ROTATING TREATMENT AND DEVICE FOR DRINKS CONTAINERS," published on Aug. 11, 1988; DE 203 04 296, having the following English translation of the German title "ROTARY STERILIZING AND FILLING MACHINE," published on Jul. 29, 2004; and DE 32 31 128, having the following English translation of the German title "METHOD AND DEVICE FOR LABELLING UPRIGHT RECEPTACLES, ESPECIALLY STACKABLE TIN CANS," published on Feb. 23, 1984.

The patents, patent applications, and patent publication listed above, beginning on line 1066 on page 51 in the paragraph with the phrase: "Some examples of bottling plants and other features . . . " and ending on line 1116 on page 54 in the paragraph with the phrase: " . . . published on Feb. 23, 1984" are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 033 11.7, filed on Jul. 18, 2006, having inventor Ludwig CLÜSSERATH, and DE-OS 10 2006 033 11.7 and DE-PS 10 2006 033 11.7, and International Application No. PCT/EP2007/006288, having WIPO Publication No. WO 2008/009400 and inventor Ludwig CLÜSSERATH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/006288 and German Patent Application 10 2006 033 11.7 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/006288 and DE 10 2006 033 11.7 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Plant for the treatment of containers
2 Containers
2.1 Container mouth
2.2 Container flange
3 Filling machine
4, 5 Capping machine
6, 7 Conveyor
8 Transport star wheel system
9, 10 Transport star wheel
11 Drive motor
12 Rotor of the filling machine 3
13, 14 Treatment station on the rotor 12
15 Filling element
16 Container carrier
17, 18 Liquid connection
18.1 Element to compensate for different geodetic heights, usually adjustable
19 Bowl
20 Flow meter
21, 22 Ring duct
23 Transport star wheel system
24 Transport star wheel
25 Conveyor
26 Transport star wheel
27 Conveyor
A Direction of rotation of the rotor 12
E1, E2 Treatment plane or level
MA Machine axis

What is claimed is:

1. A bottling plant for filling bottles with a flowable filling material and capping filled bottles, said bottling plant comprising:

a bottle filling machine comprising:

at least one rotor having a vertical machine axis;

said at least one rotor comprising at least an upper and a lower bottle filling wheel rotatable about said vertical machine axis;

a plurality of bottle filling elements substantially equally spaced and disposed about a perimeter of said upper and said lower bottle filling wheels;

said bottle filling elements disposed with said upper bottle filling wheel being substantially vertically oriented with one of said bottle filling elements disposed with said lower bottle filling wheel;

said upper and said lower bottle filling wheels being vertically spaced in substantially parallel planes, said upper and lower bottle filling wheels being vertically spaced by an amount sufficient to permit a bottle filling element and a bottle to be disposed between said upper and said lower bottle filling wheels;

said bottle filling elements being configured to dispense a flowable filling material through a lower flowable filling material outlet;

said bottle filling elements comprising a flowable filling material inlet above said flowable filling material outlet;

said flowable filling material inlets being in flow communication with a corresponding flow meter;

said flow meters being in flow communication with a flowable filling material connection;

a sole flowable filling material reservoir above said flow meters and in flow communication with said flow meters through said flowable filling material connection;

a pressure reducing element in flow communication with said flowable filling material connection, said pressure reducing element being disposed between said upper and said lower bottle filling wheels;

said pressure reducing element being configured to reduce pressure of flowable filling material flowing to said lower bottle filling wheel such that the pressure of flowable filling material flowing to said flow meters of said lower bottle filling wheel is substantially equalized with the pressure of flowable filling material flowing to said flow meters of said upper bottle filling wheel;

a motor configured to rotate said upper and said lower bottle filling wheels at substantially the same rotational speed about said vertical machine axis; and a bottle carrier below said bottle filling elements configured to receive and dispose a bottle about a bottle flange with a bottle mouth below said flowable filling material outlet of said bottle filling elements;

said bottling plant further comprising:

a bottle filling machine bottle outlet comprising:

an upper conveying apparatus rotatable about a vertical axis thereof configured to collect filled bottles from said upper bottle filling wheel;

a lower conveying apparatus rotatable about the vertical axis of said upper conveying apparatus and configured to collect filled bottles from said lower bottle filling wheel;

said upper conveying apparatus being configured to dispose bottles through an upper rotational distance; and said lower conveying apparatus being configured to dispose bottles through a lower rotational distance, said upper rotational distance being different than said lower rotational distance;

said bottling plant further comprising:

an upper bottle capping machine configured to collect filled bottles from said upper conveying apparatus at said upper rotational distance from said bottle filling machine and cap filled bottles;

a lower bottle capping machine configured to collect filled bottles from said lower conveying apparatus at said lower rotational distance from said bottle filling machine and cap filled bottles;

said difference between said upper and said lower rotational distances of said upper and said lower conveying apparatus being sufficient to dispose said upper and said lower bottle capping machines sufficiently far apart to permit unimpeded operation of said upper and said lower bottle capping machines; and said upper and said lower bottle capping machines each having a height substantially greater than the vertical spacing between said upper and said lower conveying apparatuses.

2. The bottling plant of claim 1 further comprising a bottle conveying apparatus, said bottle conveying apparatus comprising an upper and a lower bottle conveyor, said upper conveyor being configured to convey bottles to said upper bottle filling wheel and said lower conveyor being configured to convey bottles to said lower bottle filling wheel.

3. The bottling plant of claim 2 wherein said upper filling wheel is configured to dispose a bottle of a first size and said lower filling wheel is configured to dispose a bottle of a second size, said first and said second size bottles being different.

4. A container filling plant for filling containers with a flowable filling material and closing filled containers, said container filling plant comprising:

a container filling machine comprising:

at least one rotor having a vertical machine axis;

said at least one rotor comprising at least an upper and a lower container filling wheel rotatable about said vertical machine axis;

a plurality of container filling elements substantially equally spaced and disposed about a perimeter of said upper and said lower container filling wheels;

said upper and said lower container filling wheels being vertically spaced in substantially parallel planes, said upper and lower container filling wheels being vertically spaced by an amount sufficient to permit a container filling element and a container to be disposed between said upper and said lower container filling wheels;

said container filling elements being configured to dispense a flowable filling material through a flowable filling material outlet;

said container filling elements comprising a flowable filling material inlet;

said flowable filling material inlets being in flow communication with a flowable filling material connection;

at least one flowable filling material reservoir in flow communication with said flowable filling material inlets of said upper and said lower container filling wheels;

a motor configured to rotate said upper and said lower container filling wheels at substantially the same rotational speed about said vertical machine axis; and a container carrier below said container filling elements configured to receive and dispose a container with a container opening below said flowable filling material outlet of said container filling elements;

said container filling plant further comprising:

a container filling machine container outlet comprising:

an upper conveying apparatus rotatable about a vertical axis thereof configured to collect filled containers from said upper container filling wheel;

a lower conveying apparatus rotatable about the vertical axis of said upper conveying apparatus and configured to collect filled containers from said lower container filling wheel;

said upper conveying apparatus being configured to dispose containers through an upper rotational distance; and said lower conveying apparatus being configured to dispose containers through a lower rotational distance, said upper rotational distance being different than said lower rotational distance;

said container filling plant further comprising:

an upper container closing machine configured to collect filled containers from said upper conveying apparatus at said upper rotational distance from said container filling machine and close filled containers;

a lower container closing machine configured to collect filled containers from said lower conveying apparatus at said lower rotational distance from said container filling machine and close filled containers;

said difference between said upper and said lower rotational distances of said upper and said lower conveying apparatuses being sufficient to dispose said upper and said lower container closing machines sufficiently far apart to permit unimpeded operation of said upper and said lower container closing machines; and said upper and said lower container closing machines each having a height substantially greater than the vertical spacing between said upper and said lower conveying apparatuses.

5. The container filling plant of claim 4 wherein said at least one flowable filling material reservoir is a sole flowable filling material reservoir.

6. The container filling plant of claim 5 further comprising a pressure reducing element in flow communication with said flowable filling material connection between said upper and said lower container filling wheels, said pressure reducing element being configured to reduce pressure of flowable filling material flowing to said lower container filling wheel such that the pressure of flowable filling material flowing to said flowable filling material inlets of said upper and said lower container filling wheels is substantially equal.

7. The container filling plant of claim 6 wherein said pressure reducing element is adjustable.

8. The container filling plant of claim 7 comprising a flow meter in flow communication with a corresponding flowable filling material inlet.

9. The container filling plant of claim 8 further comprising at least one duct configured for the delivery or removal of a gas, vapor, liquid, or combinations thereof.

10. The container filling plant of claim 9 further comprising a container conveying apparatus, said container conveying apparatus comprising an upper and a lower container conveyor, said upper conveyor being configured to convey containers to said upper container filling wheel and said lower conveyor being configured to convey containers to said lower container filling wheel.

11. The container filling plant of claim 10 wherein said upper filling wheel is configured to dispose a container of a first size and said lower filling wheel is configured to dispose a container of a second size, said first and said second size containers being different.

12. The container filling plant of claim 11 wherein said upper and said lower conveying apparatuses of said container filling machine container outlet are transport star wheels.

13. A container filling plant for filling containers with a flowable filling material and closing filled containers, said container filling plant comprising:

a container filling machine comprising:

at least one rotor having a vertical machine axis;

said at least one rotor comprising at least an upper and a lower container filling wheel rotatable about said vertical machine axis;

a plurality of container filling elements substantially equally spaced and disposed about a perimeter of said upper and said lower container filling wheels;

said upper and said lower container filling wheels being vertically spaced in substantially parallel planes, said upper and lower container filling wheels being vertically spaced by an amount sufficient to permit a container filling element and a container to be disposed between said upper and said lower container filling wheels;

said container filling elements being configured to dispense a flowable filling material through a lower flowable filling material outlet;

said container filling elements comprising a flowable filling material inlet;

said flowable filling material inlets being in flow communication with a flowable filling material connection;

a sole flowable filling material reservoir in flow communication with said flowable filling material connection;

a pressure reducing element being configured to reduce pressure of flowable filling material flowing to said flowable filling material inlets of said lower bottle filling wheel such that the pressure of flowable filling material flowing to said flowable filling material inlets of said lower bottle filling wheel are substantially equalized with the pressure of flowable filling material flowing to said flowable filling material inlets of said upper bottle filling wheel;

a motor configured to rotate said upper and said lower container filling wheels at substantially the same rotational speed about said vertical machine axis; and a container carrier below said container filling elements configured to receive and dispose a container with a container opening below said flowable filling material outlet of said container filling elements;

said container filling plant further comprising:

at least one container closing machine configured to collect and close filled containers from said container filling machine.

14. The container filling plant of claim 13 further comprising a container filling machine container outlet, said container outlet comprising:

an upper conveying apparatus rotatable about a vertical axis thereof configured to collect filled containers from said upper container filling wheel;

a lower conveying apparatus rotatable about the vertical axis of said upper conveying apparatus and configured to collect filled containers from said lower container filling wheel;

said upper conveying apparatus being configured to dispose containers through an upper rotational distance; and said lower conveying apparatus being configured to dispose containers through a lower rotational distance, said upper rotational distance being different than said lower rotational distance.

15. The container filling plant of claim 14 wherein said at least one closing machine comprises:

an upper container closing machine configured to collect filled containers from said upper conveying apparatus at said upper rotational distance from said container filling machine and close filled containers;

a lower container closing machine configured to collect filled containers from said lower conveying apparatus at said lower rotational distance from said container filling machine and close filled containers;

said difference between said upper and said lower rotational distances of said upper and said lower conveying apparatuses being sufficient to dispose said upper and said lower container closing machines sufficiently far apart to permit unimpeded operation of said upper and said lower container closing machines; and said upper and said lower container closing machines each having a height substantially greater than the vertical spacing between said upper and said lower conveying apparatuses.

16. The container filling plant of claim 15 wherein said pressure reducing element is adjustable.

17. The container filling plant of claim 16 comprising a flow meter in flow communication with a corresponding flowable filling material inlet.

18. The container filling plant of claim 17 further comprising at least one duct configured for the delivery or removal of a gas, vapor, liquid, or combinations thereof.

19. The container filling plant of claim 18 further comprising a container conveying apparatus, said container conveying apparatus comprising an upper and a lower container conveyor, said upper conveyor being configured to convey containers to said upper container filling wheel and said lower conveyor being configured to convey containers to said lower container filling wheel.

20. The container filling plant of claim 19 wherein said upper filling wheel is configured to dispose a container of a first size and said lower filling wheel is configured to dispose a container of a second size, said first and said second size containers being different.

* * * * *